United States Patent [19]

Geib et al.

[11] Patent Number: 4,917,634

[45] Date of Patent: Apr. 17, 1990

[54] ELECTRICAL CONNECTOR

[75] Inventors: Lawrence E. Geib, Carol Stream; Herbert C. Naylor, West Dundee, both of Ill.

[73] Assignee: Reed Devices, Inc., Carol Stream, Ill.

[21] Appl. No.: 65,922

[22] Filed: Jun. 24, 1987

[51] Int. Cl.[4] ..... H01R 13/432

[52] U.S. Cl. ..... 439/746; 439/744

[58] Field of Search ..... 439/397, 401, 404, 744, 439/746

[56] References Cited

U.S. PATENT DOCUMENTS

| | | | |
|---|---|---|---|
| 3,982,805 | 9/1976 | Irie | 339/59 R |
| 4,030,304 | 6/1977 | Enomoto | 339/258 S |
| 4,053,197 | 10/1977 | Teagno | 439/404 |
| 4,474,418 | 10/1984 | Yamada | 339/65 |
| 4,537,462 | 8/1985 | Manabe | 339/259 R |
| 4,557,543 | 12/1985 | McCleery et al. | 439/744 X |
| 4,571,017 | 2/1986 | Fujita | 339/59 M |
| 4,583,813 | 4/1986 | Yamada | 339/91 R |
| 4,790,777 | 12/1988 | Iimori et al. | 439/744 |

FOREIGN PATENT DOCUMENTS

| | | | |
|---|---|---|---|
| 2024538 | 1/1980 | United Kingdom | 439/744 |

*Primary Examiner*—Eugene F. Desmond

*Attorney, Agent, or Firm*—Weingarten, Schurgin, Gagnebin & Hayes

[57] ABSTRACT

An electrical connector in which electrical terminals are retained within a connector housing in a simple and reliable manner to withstand expected pulling forces without unwanted release of the terminals from the housing. The housing has one or more passageways for receiving respective terminals, an abutment at the inner end of each passageway to limit the insertion depth of the associated terminal, a V-grooved abutment in each passage cooperative with yieldable tines of an associated terminal to retain the terminal in place after insertion into its passage, and walls defining each passage for maintaining the associated terminal in position after insertion into the housing.

8 Claims, 2 Drawing Sheets

ELECTRICAL CONNECTOR

FIELD OF THE INVENTION

This invention relates to electrical connectors and more particularly to an electrical connector in which the terminals are retained within a connector housing.

BACKGROUND OF THE INVENTION

Electrical connectors are known in which electrical terminals are inserted and retained within a connector housing such that after insertion the terminals remain captured and Positioned within the housing for proper mating of the connector housing with a cooperative housing of a mateable connector assembly. Each terminal has an element which is cooperative with a portion of the connector housing to secure the terminal within the housing. A difficulty often arises in such constructions in that the terminal retaining element can be damaged by Pulling forces on the terminal such as can occur by pulling on the wire attached to the terminal, and thereby break the terminal loose from the housing. This difficulty is accentuated in connectors of small size by reason of the relatively delicate nature of the small size terminals.

SUMMARY OF THE INVENTION

The present invention provides the desirable result of an improved connector in which electrical terminals are efficiently retained within a connector housing in a simple and reliable manner and which can withstand the expected pulling forces without unwanted release of the terminals from their housing. The improved terminal and connector housing provides the intended benefits even in connector assemblies of small size.

The connector housing has one or more passageways for receiving respective terminals, an abutment at the inner end of each passageway to limit the insertion depth of the associated terminal, a V-grooved abutment in each passage cooperative with yieldable tines of an associated terminal to retain the terminal in place after insertion into its passage, and walls defining each passage for maintaining the associated terminal in position after insertion. Each terminal is of stamped and formed construction, configured to cooperate with the walls and constituents of the respective housing passage for alignment therein, such that the terminals retained in the housing can be plugged onto a cooperative connector housing having terminals mateable with these terminals, as well as being unpluggable therefrom.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
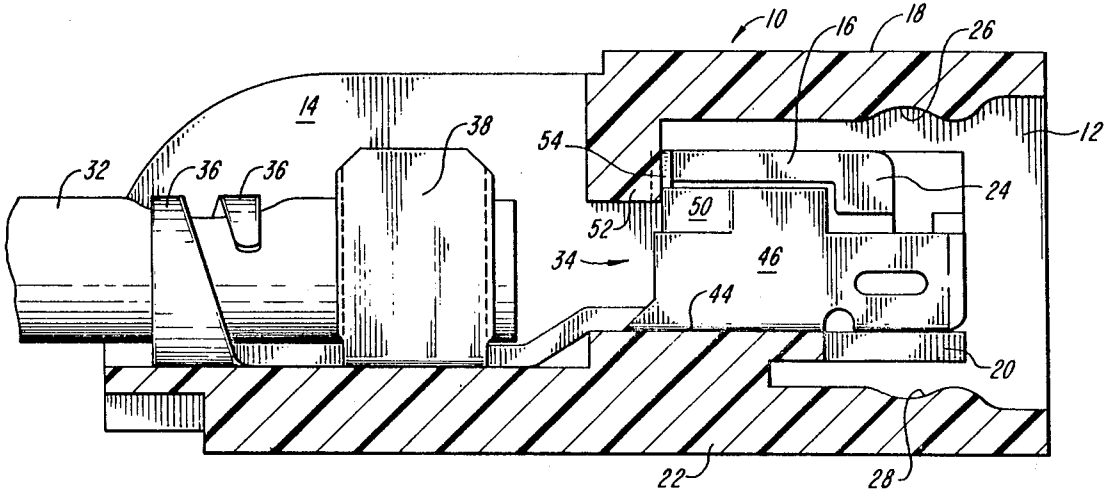
FIG. 1 is a sectional elevation view of a connector in accordance with the invention and with the terminal seated within the connector housing.
Figure 2:
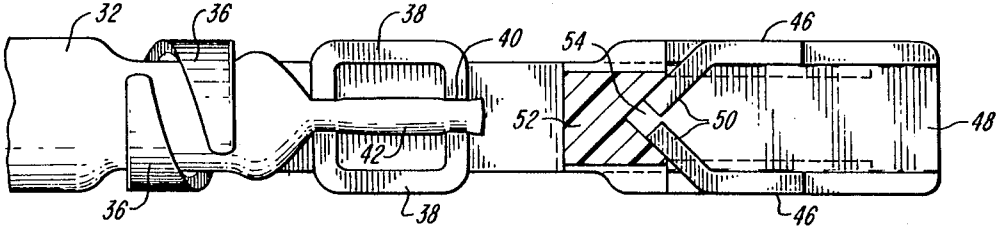
FIG. 2 is a cutaway top view of the connector of FIG. 1 illustrating the latching of the terminal in the connector housing.
Figure 3:
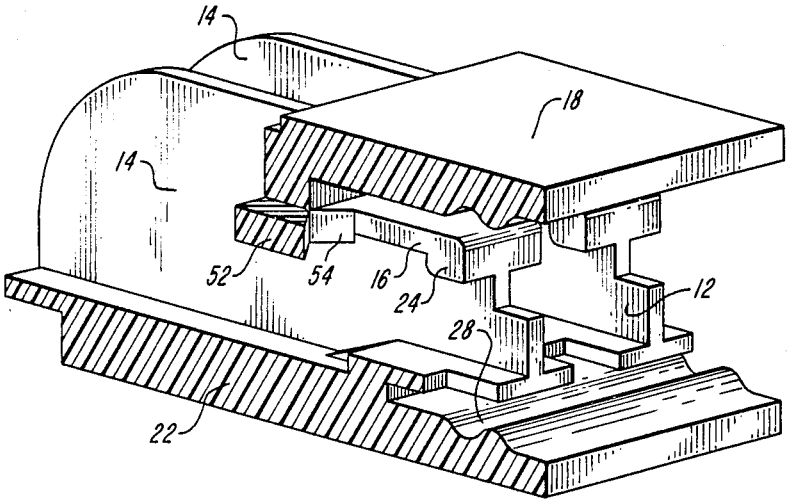
FIG. 3 is cutaway pictorial view of the connector housing in accordance with the invention.

Referring to the drawing FIGS. 1–3 there is shown a connector housing 10 molded or otherwise formed of an electrically insulative material and having a passageway 12 for each electrical terminal retained therein. Typically a Plurality of terminals are retained in respective parallel passageways within the housing for mating with complementary terminals of an associated housing, such as that shown in FIG. 4. Each passageway is defined by side walls 14, a top member 16 spaced from top wall 18, and bottom member 20 spaced from bottom wall 22. The bottom member 20 defines a floor on which the terminal rests. The top member 16 includes an inwardly extending lip 24 which serves as an abutment to limit the inward insertion depth of the terminal, as seen in FIG. 1. The top and bottom members 16 and 20 are integral with the wall 14 and provide a rigid structure defining the terminal passageway. The forward end of the housing includes laterally extending groves 26 and 28 in respective upper and lower walls which are cooperative with the lateral ridges 30 and 32 of the mateable connector (FIG. 4), for latching the connector housings together.

The electrical terminal 34 is of stamped and formed construction and has tabs 36 which are bent over the insulation 32 of the terminal wire for retention of the wire in position, and confronting contact tabs 38 which have insulation displacement (IDC) grooves 40 defined by the confronting tabs in which the insulated wire 42 is inserted for electrical contact with the terminal. The wire can alternatively be stripped and the bared wire soldered to appropriate portions provided on the terminals. The terminals are inserted via the rearward end of respective passageways for seating therein. The forward end of the terminal is of generally rectangular cross-section having a flat bottom wall 44 which is supported by the bottom wall of the associated passageway, planar side walls 46 which confront the respective side walls 14, and a forward opening 48 which confronts the forward face of the housing 10 for acceptance of the mateable terminal 49 of the cooperative housing (FIG. 4).

A pair of inwardly directed shear tabs 50 are operative during insertion of the terminal into the passage to yieldably move automatically past the inwardly extending element 52 of the housing. After insertion of the terminal to abut respective lips 24, the tabs 50 spring inward into confrontation with the forward-facing V-groove 54 of the element 52. Any rearward movement of the terminal causes the lips 50 to cooperate with the forward facing V-groove 54 to prevent unintentional withdrawal of the terminal from the housing. The terminal will remain seated within its passageway even in the presence of pulling forces on the wire connected to the terminal. Thus inadvertent release of the terminal from its housing is substantially minimized by the improved construction of the terminal and cooperative housing.

Figure 4:
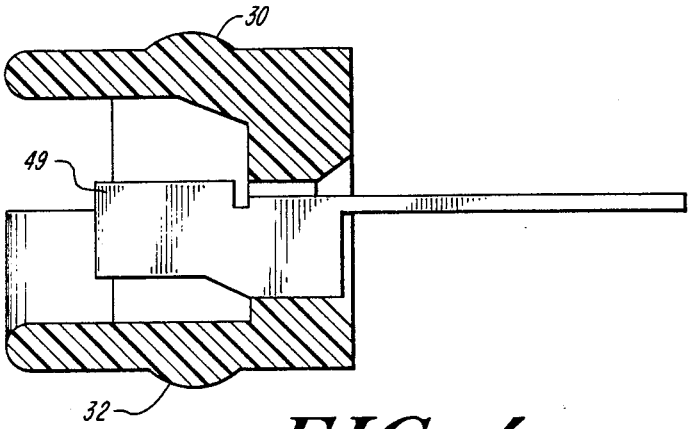
FIG. 4 is a sectional elevation view of a prior art connector housing mateable with the connector housing of the invention.

The housing and terminal installed therein described above can be mated with a cooperative housing and terminal which can be of known construction, such as that shown in FIG. 4. When mated together, the upper wall of the FIG. 4 housing fits within the space of the housing 10 defined by the upper wall 18 and upper member 16. Similarly the lower wall of the FIG. 4 housing fits within the space defined by the lower wall 22 and lower member 20 of the housing 10. The housings are retained together by seating of the ridges 30 and 32 of the FIG. 4 housing in the cooperative grooves 26 and 28 of the housings. The terminal of the FIG. 4 housing fits within and is in electrical engagement with the confronting end of the terminal 34 to provide electrical interconnection between the mated terminals.

The invention is not to be limited by what has been shown or described, except as indicated in the appended claims.

What is claimed is:

1. An electrical connector comprising:

a housing of electrically insulative material having:

top and bottom members spaced from respective top and bottom housing walls, side members integral with the top and bottom members, one or more parallel passageways each having a forward end and a rearward end; defined by the top and bottom members and side members, the top member having an inwardly extending first abutment in each passageway to act as an insertion stop, a second abutment centrally of each passageway having a forwardly facing V-groove, a terminal insertable in each passageway and having a forward end portion engageable with the first abutment, a pair of yieldable tines cooperative with the V-groove, a forward contact portion mateable with a terminal of a mating connector housing, and a rearward portion having means for contacting an attached wire.

2. The connector of claim 1 wherein the top and bottom members and spaced respective top and bottom housing walls define upper and lower spaces adapted for receiving the respective walls of a mateable connector housing.

3. The connector of claim 1 wherein the forward end of the housing has one or more grooves cooperative with ridges of a mateable housing for latching the mated housings together.

4. The connector of claim 1 wherein the terminal is stamped and formed and has a plurality of tabs for engaging the insulation on the attached wire.

5. The connector of claim 4 wherein the terminal includes a portion for electrical connection to the attached wire.

6. The connector of claim 5 wherein the terminal portion is an insulation displacement contact.

7. The connector of claim 1 wherein the top and bottom members and respective top and bottom walls define respective spaces in which the walls of a mating connector housing are disposed.

8. The connector of claim 7 wherein the forward end of the housing includes means for retaining a mating connector housing.

* * * * *

UNITED STATES PATENT AND TRADEMARK OFFICE

CERTIFICATE OF CORRECTION

PATENT NO. : 4,917,634

DATED : April 17, 1990

INVENTOR(S) : Lawrence E. Geib, et al.

It is certified that error appears in the above-identified patent and that said Letters Patent is hereby corrected as shown below:

In Column 1, line 14, "Positioned" should read --positioned--

In Column 1, line 21, "Pulling" should read --pulling--.

In Column 2, line 8, "Plurality" should read --plurality--.

In Column 2, line 47, "automatically" should read --outwardly--.

Signed and Sealed this

Twenty-third Day of June, 1992

*Attest:*

DOUGLAS B. COMER

*Attesting Officer*

*Acting Commissioner of Patents and Trademarks*